US006050427A

United States Patent [19]

Loveland

[11] Patent Number: 6,050,427

[45] Date of Patent: Apr. 18, 2000

[54] DOOR HINGE PIN HOOK

[76] Inventor: Chet B. Loveland, 220 Discovery Bay Blvd., Byron, Calif. 94514

[21] Appl. No.: 08/971,507

[22] Filed: Nov. 17, 1997

[51] Int. Cl.[7] ..... A47F 5/00

[52] U.S. Cl. ..... 211/119.4; 211/96; 248/290.1

[58] Field of Search ..... 211/119.004, 96; 248/290.1

[56] References Cited

U.S. PATENT DOCUMENTS

| | | | |
|---|---|---|---|
| 69,587 | 10/1867 | Putnam | 248/290.1 |
| 223,963 | 1/1880 | Taylor | 211/96 X |
| 914,697 | 3/1909 | Bryant | 248/290.1 |
| 3,044,630 | 7/1962 | Szabo | 211/119.004 |

*Primary Examiner*—Robert W. Gibson, Jr.

[57] ABSTRACT

A door hinge pin hook including a hook portion having a tab extending rearwardly therefrom. The tab has an aperture therethrough. The hook portion couples with an existing door hinge by positioning the tab on an upper edge of the door hinge with the aperture in alignment with a hole extending through the door hinge. A hinge pin is provided having a length equal to a length of the existing door hinge and a width of the tab of the hook portion. The hinge pin is slidably received through the aperture in the tab and extending downwardly through the hole in the door hinge.

1 Claim, 2 Drawing Sheets

DOOR HINGE PIN HOOK

BACKGROUND OF THE INVENTION

1. Field of the Invention

The present invention relates to a door hinge pin hook and more particularly pertains to coupling with a door hinge for hanging articles therefrom with a door hinge pin hook.

2. Description of the Prior Art

The use of door hooks is known in the prior art. More specifically, door hooks heretofore devised and utilized for the purpose of hanging articles from a door are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,817,239 to Campbell et al.; U.S. Pat. No. 4,358,871 to Takai; U.S. Pat. No. Des. 247,146 to Watt, Jr.; U.S. Pat. No. 5,117,987 to Lombardo; U.S. Pat. No. 4,721,212 to Lowe; and U.S. Pat. No. 3,913,171 to Reid.

While these devices fulfill their respective, particular objective and requirements, the aforementioned patents do not describe a door hinge pin hook for coupling with a door hinge for hanging articles therefrom.

In this respect, the door hinge pin hook according to the present invention substantially departs from the conventional concepts and designs of the prior art, and in doing so provides an apparatus primarily developed for the purpose of coupling with a door hinge for hanging articles therefrom.

Therefore, it can be appreciated that there exists a continuing need for new and improved door hinge pin hook which can be used for coupling with a door hinge for hanging articles therefrom. In this regard, the present invention substantially fulfills this need.

SUMMARY OF THE INVENTION

In the view of the foregoing disadvantages inherent in the known types of door hooks now present in the prior art, the present invention provides an improved door hinge pin hook. As such, the general purpose of the present invention, which will be described subsequently in greater detail, is to provide a new and improved door hinge pin hook and method which has all the advantages of the prior art and none of the disadvantages.

To attain this, the present invention essentially comprises a hook portion having a curved rear portion and an upper hook and a lower hook. The curved rear portion has a tab extending rearwardly therefrom. The tab has an aperture therethrough. The hook portion couples with an existing door hinge by positioning the tab on an upper edge of the door hinge with the aperture in alignment with a hole extending through the door hinge. A hinge pin is provided having a length equal to a length of the existing door hinge and a width of the tab of the hook portion. The hinge pin is slidably received through the aperture in the tab and extending downwardly through the hole in the door hinge.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door hinge pin hook which has all the advantages of the prior art door hooks and none of the disadvantages.

It is another object of the present invention to provide a new and improved door hinge pin hook which may be easily and efficiently manufactured and marketed.

It is a further object of the present invention to provide a new and improved door hinge pin hook which is of durable and reliable construction.

An even further object of the present invention is to provide a new and improved door hinge pin hook which is susceptible of a low cost of manufacture with regard to both materials and labor, and which accordingly is then susceptible of low prices of sale to the consuming public, thereby making such a door hinge pin hook economically available to the buying public.

Even still another object of the present invention is to provide a new and improved door hinge pin hook for coupling with a door hinge for hanging articles therefrom.

Lastly, it is an object of the present invention to provide a new and improved door hinge pin hook including a hook portion having a tab extending rearwardly therefrom. The tab has an aperture therethrough. The hook portion couples with an existing door hinge by positioning the tab on an upper edge of the door hinge with the aperture in alignment with a hole extending through the door hinge. A hinge pin is provided having a length equal to a length of the existing door hinge and a width of the tab of the hook portion. The hinge pin is slidably received through the aperture in the tab and extending downwardly through the hole in the door hinge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
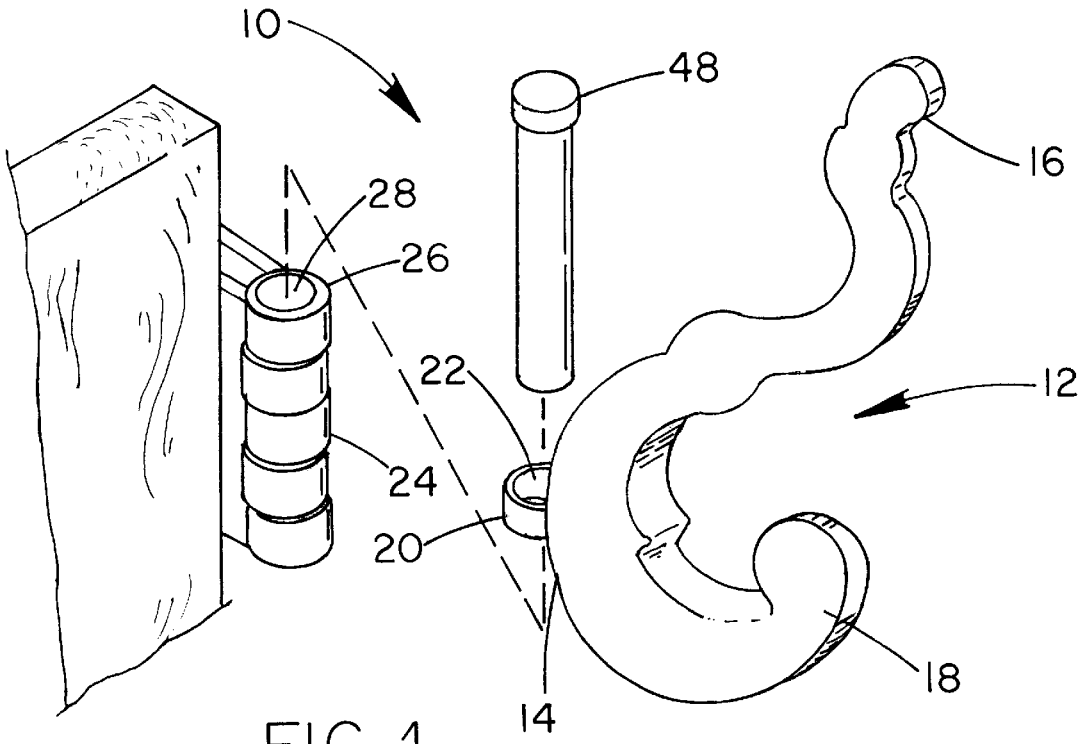
FIG. 1 is a perspective view of the preferred embodiment of the door hinge pin hook constructed in accordance with the principles of the present invention.

With reference now to the drawings, and in particular, to FIGS. 1 through 4 thereof, the preferred embodiment of the new and improved door hinge pin hook embodying the principles and concepts of the present invention and generally designated by the reference number 10 will be described.

Specifically, it will be noted in the various Figures that the device relates to a door hinge pin hook for coupling with a door hinge for hanging articles therefrom. In its broadest context, the device consists of a hook portion and a hinge pin. Such components are individually configured and correlated with respect to each other so as to attain the desired objective.

The hook portion 12 has a curved rear portion 14 and an upper hook 16 and a lower hook 18. The curved rear portion 14 has a tab 20 extending rearwardly therefrom. The tab 20 has an aperture 22 therethrough. The hook portion 12 couples with an existing door hinge 24 by positioning the tab 20 on an upper edge 26 of the door hinge 24 with the aperture 22 in alignment with a hole 28 extending through the door hinge 24.

Figure 2:
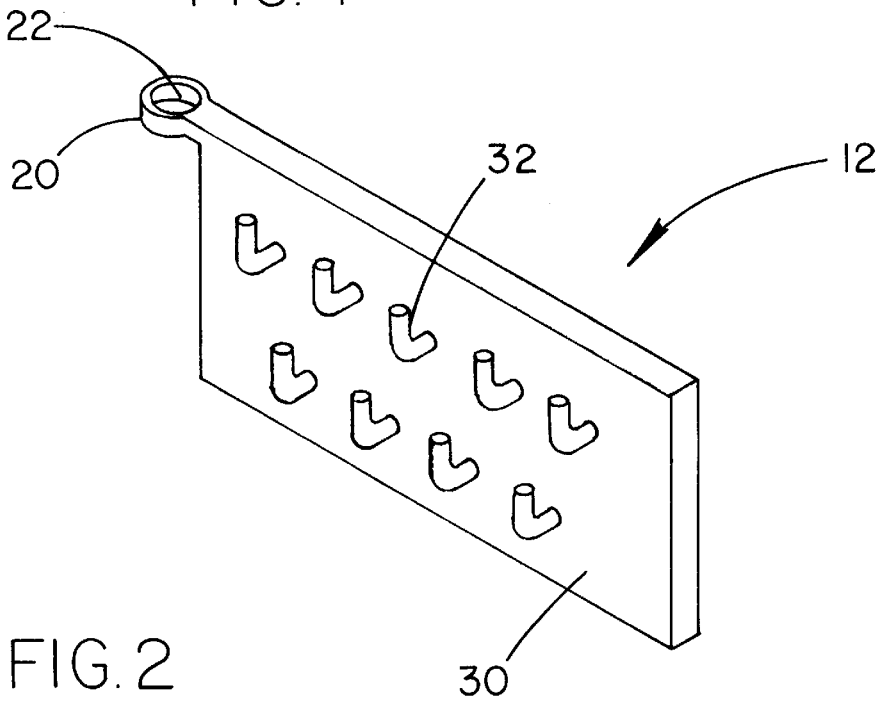
FIG. 2 is a perspective view of an alternate type of hook of the present invention.
Figure 3:
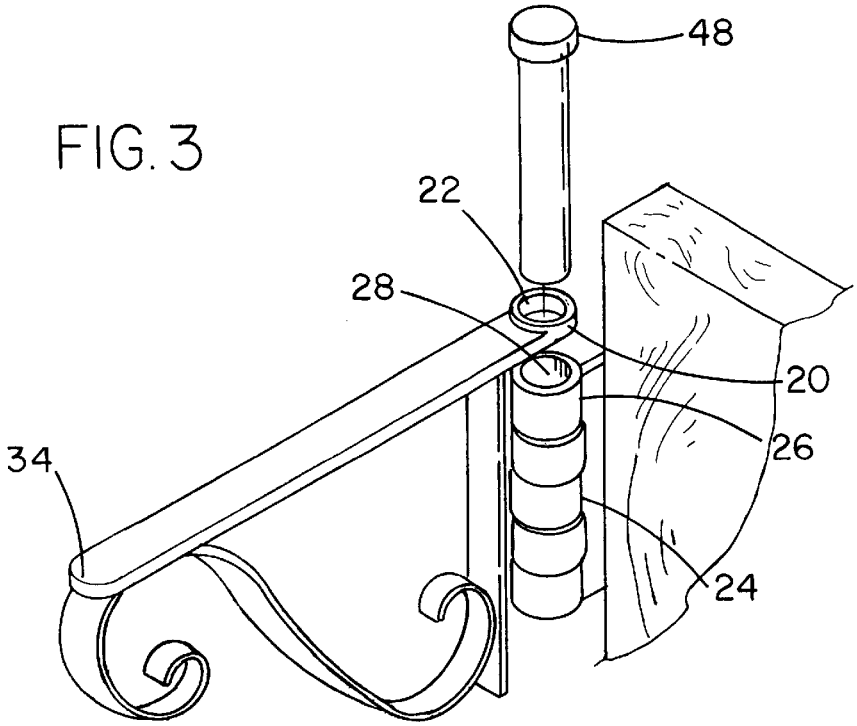
FIG. 3 is a perspective view of an alternate type of hook of the present invention.
Figure 4:
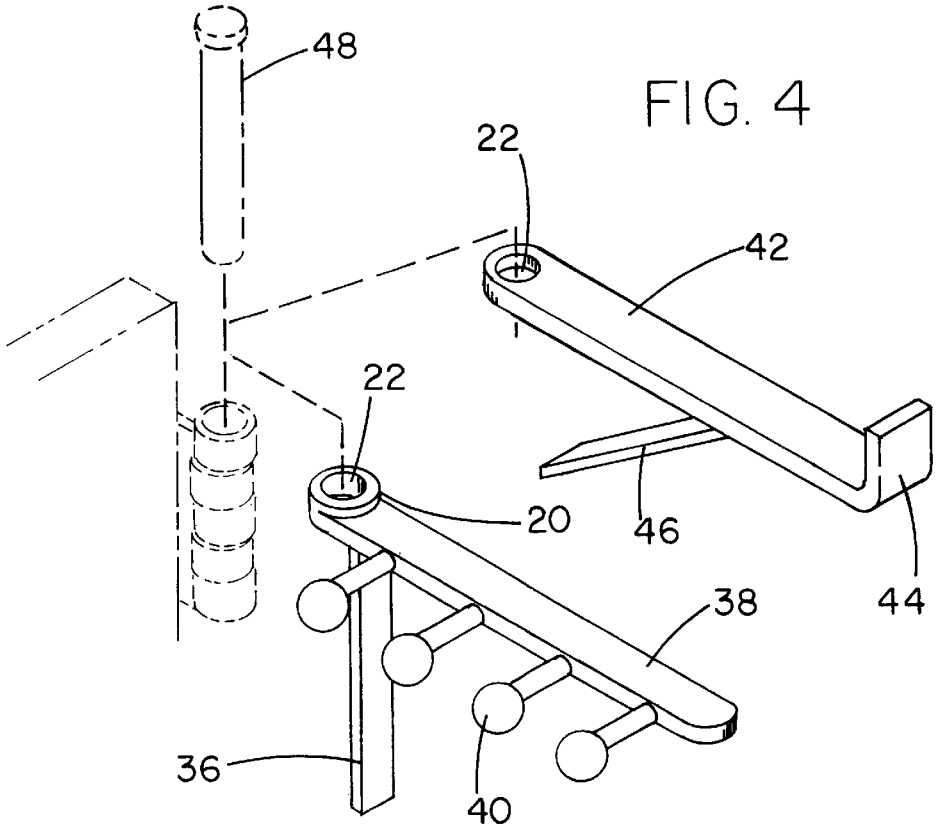
FIG. 4 is a perspective view of a pair of alternate types of hooks of the present invention.

Alternate designs of the hook portion 12 are illustrated in FIGS. 2 through 4. In FIG. 2, the hook portion 12 is comprised of a planar rectangular board 30 having a plurality of hooks 32 disposed thereon. In FIG. 3, the hook portion 12 is comprised of a bracket hook 34 for hanging plants. In FIG. 4, two types are illustrated. In one of the types, the hook portion 12 is comprised of an L-shaped bracket with a vertical component 36 and a horizontal component 38. The horizontal component 38 has a plurality of hooks 40 extending outwardly therefrom in a linear orientation. In the other type, the hook portion 12 is comprised of an elongated planar bar 42 with an upturned end portion 44. The planar bar 42 has an angular support bar 46 extending rearwardly therefrom.

The hinge pin 48 has a length equal to a length of the existing door hinge 24 and a width of the tab 20 of the hook portion 12. The hinge pin 48 is slidably received through the aperture 22 in the tab 20 and extending downwardly through the hole 28 in the door hinge 24.

In use, the existing hinge pin is removed from the door hinge 24. The hook portion 12 is then placed atop the door hinge 24 with the tab 20 in alignment therewith. The longer hinge pin 48 then slides through the tab 20 and the door hinge 24 to facilitate securement. A person can then freely hang garments or the like from the hook portion 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A door hinge pin hook for coupling with a door hinge for hanging articles therefrom comprising, in combination:

a hook portion having a curved rear portion and an upper hook and a lower hook, the curved rear portion having a tab extending rearwardly therefrom, the tab having an aperture therethrough, the tab having a singular smooth rear surface, the tab being positioned with respect to the hook portion whereby the upper hook is disposed at a level above the tab and the lower hook is disposed at a level essentially level with and below the tab, the hook portion coupling with an existing door hinge by positioning the tab on an upper edge of the door hinge with the aperture in alignment with a hole extending through the door hinge whereby the configuration of the tab facilitates unimpeded rotation with respect to the existing door hinge; and a hinge pin having a length equal to a length of the existing door hinge and a width of the tab of the hook portion, the hinge pin slidably received through the aperture in the tab and extending downwardly through the hole in the door hinge.

* * * * *